US008122612B2

(12) United States Patent
Knight, III et al.

(10) Patent No.: US 8,122,612 B2
(45) Date of Patent: Feb. 28, 2012

(54) SYSTEM FOR INDICATING THE ENGAGEMENT DEPTH OF THREADABLY ENGAGED SURFACES

(75) Inventors: Stephen J. Knight, III, Littleton, CO (US); William E. Kugler, Denver, CO (US)

(73) Assignee: United Construction Products, Inc., Denver, CO (US)

( * ) Notice: Subject to any disclaimer, the term of this patent is extended or adjusted under 35 U.S.C. 154(b) by 382 days.

(21) Appl. No.: 12/539,489

(22) Filed: Aug. 11, 2009

(65) Prior Publication Data

US 2010/0050457 A1 Mar. 4, 2010

Related U.S. Application Data

(63) Continuation-in-part of application No. 12/202,319, filed on Aug. 31, 2008, now Pat. No. 7,921,612.

(51) Int. Cl.
*G01B 5/18* (2006.01)

(52) U.S. Cl. ..... 33/836; 33/542; 33/199 R

(58) Field of Classification Search ..... 33/833, 33/836, 542, 543, 199 R; 52/126.6
See application file for complete search history.

(56) References Cited

U.S. PATENT DOCUMENTS

| | | | | |
|---|---|---|---|---|
| 3,827,154 | A * | 8/1974 | Kaifesh | 33/199 R |
| 4,356,636 | A * | 11/1982 | Roberts | 33/199 R |
| 4,590,678 | A * | 5/1986 | Arredondo | 33/199 R |
| 4,965,936 | A * | 10/1990 | Sentman | 33/199 R |
| 5,377,417 | A * | 1/1995 | Sentman | 33/199 R |
| 5,588,264 | A | 12/1996 | Buzon | |
| 6,332,292 | B1 | 12/2001 | Buzon | |
| 6,363,685 | B1 | 4/2002 | Kugler | |
| 7,762,005 | B2 * | 7/2010 | Pelotte | 33/836 |
| 7,877,882 | B2 * | 2/2011 | Burr | 33/199 R |
| 7,921,612 | B2 * | 4/2011 | Knight et al. | 52/126.6 |
| 2002/0148173 | A1 | 10/2002 | Kugler | |
| 2003/0101602 | A1 * | 6/2003 | Galestien | 33/199 R |
| 2004/0035064 | A1 | 2/2004 | Kugler et al. | |
| 2004/0261329 | A1 | 12/2004 | Kugler et al. | |
| 2008/0105172 | A1 | 5/2008 | Repasky | |
| 2010/0050457 | A1 * | 3/2010 | Knight et al. | 33/836 |
| 2011/0023385 | A1 * | 2/2011 | Knight et al. | 52/126.6 |

(Continued)

FOREIGN PATENT DOCUMENTS

EP 1304426 A2 4/2003

OTHER PUBLICATIONS

Brochure entitled "Assembly Instructions, Bison Level.It Adjustable Deck Supports", Bison Deck Supports, a United Construction Products, Inc. Company, dated 2005.

(Continued)

*Primary Examiner* — Yaritza Guadalupe-McCall
(74) *Attorney, Agent, or Firm* — Marsh Fischmann & Breyfogle LLP

(57) ABSTRACT

A system for indicating a depth of engagement of two threadably engaged surfaces of a support pedestal. The system includes at least a first thread protuberance disposed on a first threaded surface of the support pedestal and at least a second thread protuberance disposed on a second threaded surface of the support pedestal. The first thread protuberance impinges against the second thread protuberance when the first and second threaded surfaces are threadably engaged and rotated to provide sensory indication of a depth of engagement of the first and second threaded surfaces.

29 Claims, 6 Drawing Sheets

U.S. PATENT DOCUMENTS

2011/0185675 A1* 8/2011 Knight et al. ..... 52/741.1

OTHER PUBLICATIONS

Brochure entitled "Complete Pedestal, Bison Level.lt Adjustable Deck Supports", Bison Deck Supports, a United Construction Products, Inc. Company, dated Apr. 2007.

Brochure entitled "New Hanover Elevator Pedestal System", Hanover Architectural Products, dated 2007.

Eternoivica Catalogue Price List, pp. 58-67, dated 2008.

Brochure entitled "VersiJack 75", Elmich, dated May 2007.

Brochure entitled "Bison ScrewJack Specification", Bison Screwjack Co., a division of United Construction Products, Inc., dated 2003.

* cited by examiner

SYSTEM FOR INDICATING THE ENGAGEMENT DEPTH OF THREADABLY ENGAGED SURFACES

CROSS-REFERENCE TO RELATED APPLICATIONS

This application is a continuation-in-part application of U.S. patent application Ser. No. 12/202,319, filed on Aug. 31, 2008, which is incorporated herein by reference in its entirety.

BACKGROUND OF THE INVENTION

1. Field of the Invention

This invention relates to the field of threaded support pedestals, such as for supporting an elevated surface above a fixed surface for elevated floors, decks, walkways and similar building assemblies.

2. Description of Related Art

Elevated building surfaces such as elevated floors, decks, terraces and walkways are desirable in many environments. One common system for creating such surfaces includes a plurality of surface tiles, such as concrete tiles (pavers), stone tiles or wood tiles, and a plurality of spaced-apart support pedestals upon which the tiles are placed to be supported above a fixed surface. For example, in outdoor applications, the surface tiles may be elevated above a fixed surface by the support pedestals to promote drainage, to provide a level structural surface for walking, and/or to prevent deterioration of or damage to the surface tiles forming the building surface. The support pedestals can have a fixed height, or can have an adjustable height such as to accommodate variations in the contour of the fixed surface upon which the support pedestals are placed, or to create desirable architectural features.

In many applications the surface tiles are rectangular in shape, having four corners. Each of the spaced-apart support pedestals can therefore support the corners of four adjacent surface tiles at the tile corners. Stated another way, each surface tile can be supported by portions of four support pedestals that are disposed under each of the four corners of the tile. However, tiles of other shapes and configurations can be utilized. Support pedestals can also be placed under the tiles at locations other than the corners, such as under a central portion of the tiles.

One example of a support pedestal is disclosed in U.S. Pat. No. 5,588,264 by Buzon, which is incorporated herein by reference in its entirety. The support pedestal disclosed by Buzon can be used in outdoor or indoor environments and is capable of supporting heavy loads applied by many types of building surfaces. The pedestal includes a threaded base member and a threaded support member that is rotatably engaged with the base member to enable the height of the support pedestal to be adjusted by rotating the support member or the base member relative to the other. The support pedestal can also include a coupling member that can couple the base member to the support member for further increasing the height of the support pedestal, if necessary. Buzon also discloses the use of indicator slots to visually inform the user that the maximum safe extension of the support member above the base member has been reached.

Support pedestals are also disclosed in U.S. Pat. No. 6,363,685 by Kugler and U.S. Patent Publication No. 2004/0261329 by Kugler et al., each of which is incorporated herein by reference in its entirety.

SUMMARY OF THE INVENTION

Thus, support pedestals can include threaded pedestal members that are assembled by rotatably engaging the pedestal members. A majority of the load placed upon the support pedestal is typically borne by the threads. Each threaded pedestal member must often be rotatably engaged with its mating pedestal member to at least a minimum depth that is sufficient to maintain the structural integrity of the pedestal. One problem that may be encountered is that it may be difficult for an operator assembling the structure to ascertain if the minimum engagement depth has been reached.

It is an objective to provide a system for indicating the depth of engagement of two threadably engaged surfaces of a support pedestal. It is another objective to provide a system for indicating the depth of engagement of two threadably engaged surfaces of a support pedestal that eliminates the need for visual confirmation of the engagement depth by the operator.

Accordingly, in one embodiment, a system for indicating a depth of engagement of two threadably engaged surfaces of a support pedestal is provided. The system may include at least a first thread protuberance disposed on a first threaded surface of the support pedestal. The system may also include at least a second protuberance disposed on a second threaded surface of the support pedestal, whereby the first thread protuberance impinges against the second thread protuberance when the first and second threaded surfaces are threadably engaged and rotated. The impingement of the first thread protuberance against the second thread protuberance advantageously may provide sensory indication of a depth of engagement of the first and second threaded surfaces.

A number of feature refinements and additional features may be separately applicable to the foregoing embodiment. These feature refinements and additional features may be implemented individually or in any combination. For example, in one aspect, the first and second thread protuberances do not frictionally engage an opposing threaded surface when the first and second thread protuberances are not in physical contact. In this manner, relative rotation of the threadably engaged first and second threaded surfaces is not inhibited by the protuberances. In another aspect, the first thread protuberance and the second thread protuberance become frictionally engaged when they are in physical contact such that relative rotation of the first and second threaded surfaces in at least one direction is inhibited. In another aspect, the impingement of the first thread protuberance and the second thread protuberance may cause a tactile vibration as the first thread protuberance and the second thread protuberance are moved past each other during relative rotation of the threadably engaged first and second surfaces. In another aspect, the impingement of the first thread protuberance and the second thread protuberance may cause an audible sound as the first thread protuberance and the second thread protuberance are moved past each other during relative rotation of the threadably engaged first and second threaded surfaces.

In yet another aspect, the first thread protuberance has a non-symmetrical shape whereby resistance to rotation of the engaged first and second threaded surfaces is greater in one rotational direction than in the other rotational direction when the second thread protuberance moves past the first thread protuberance.

The threaded surfaces may include threads having thread crests and thread sidewalls, and thread roots disposed between adjacent thread sidewalls. The protuberances may be disposed on or within any one of the thread crests, thread roots, thread sidewalls, or any combination thereof. In one aspect, the first thread protuberance is disposed within a thread root of the first threaded surface. In another aspect, the second thread protuberance is disposed on a thread crest of the second threaded surface. In another aspect, the first thread protuberance may be disposed on a thread sidewall of the first threaded surface, and the second thread protuberance may be disposed on a thread sidewall of the second threaded surface.

Either of the first and second threaded surfaces may comprise a single thread protuberance, or may comprise a plurality of thread protuberances. In one aspect, a plurality of spaced-apart thread protuberances is disposed on the first threaded surface. In a further aspect, a plurality of spaced-apart thread protuberances is also disposed on the second threaded surface.

The support pedestal may include several support pedestal members. In one aspect, the first threaded surface is disposed on a base member and the second threaded surface is disposed on a support member of the support pedestal. A support pedestal may also include a coupling member that is adapted to operatively couple the support member to the base member. In one aspect, the coupling member includes at least a third threaded surface and at least a third thread protuberance is disposed on the third threaded surface. In this manner, sensory indication of a depth of engagement of the third threaded surface of the coupling member can be provided when the third threaded surface is threadably engaged with the first threaded surface or the second surface.

In another embodiment, a system for indicating a depth of engagement of two threadably engaged surfaces of a support pedestal is provided. This system may include a plurality of spaced-apart root protuberances that are disposed on a thread root of a first threaded surface of the support pedestal. At least a first crest protuberance is disposed on a thread crest of a second threaded surface of the support pedestal, whereby the first crest protuberance impinges against the plurality of root protuberances when the first and second threaded surfaces are threadably engaged and rotated to provide sensory indication of a depth of engagement of the threaded surfaces.

A number of feature refinements and additional features may be separately applicable to the foregoing embodiment. These feature refinements and additional features may be implemented individually or in any combination. For example, in one aspect, the root protuberances and the crest protuberance do not frictionally engage an opposing threaded surface when the protuberances are not in physical contact, such that relative rotation of the first and second threaded surfaces is not inhibited by the protuberances. In another aspect, the first and second threaded surfaces become frictionally engaged when the crest protuberance is disposed between adjacent root protuberances such that relative rotation of the first and second threaded surfaces is inhibited in both rotational directions.

In yet another aspect, impingement of the plurality of root protuberances and the crest protuberance may cause a tactile vibration as the plurality of root protuberances and the crest protuberance are moved past each other during relative rotation of the engaged first and second threaded surfaces. In a further aspect, the impingement of the plurality of root protuberances and the crest protuberance may cause an audible sound as the plurality of root protuberances and the crest protuberance are moved past each other during relative rotation of the engaged first and second threaded surfaces. In another aspect, the system includes a plurality of crest protuberances where the thread crest protuberances are disposed on the thread crest of the second threaded surface.

In another aspect, the first crest protuberance may have a non-symmetrical shape whereby resistance to rotation of the engaged first and second threaded surfaces is greater in one rotational direction than in the other rotational direction when the first crest protuberance moves past the plurality of first root protuberances. In another aspect, the first threaded surface is disposed on a pedestal support member and the second threaded surface is disposed on a pedestal base member.

In another embodiment, a system for indicating a depth of engagement of two threadably engaged surfaces of a support pedestal is provided. The system may include at least a first root protuberance disposed on a thread root of a first threaded surface of the support pedestal. A plurality of spaced-apart crest protuberances are disposed on a thread crest of a second threaded surface of the support pedestal, whereby the first root protuberance impinges against the plurality of crest protuberances when the first and second threaded surfaces are threadably engaged and rotated to provide sensory indication of a depth of engagement of the threaded surfaces.

A number of feature refinements and additional features may be separately applicable to the foregoing embodiment. These feature refinements and additional features may be implemented individually or in any combination. For example, in one aspect, the crest protuberances and the root protuberance do not frictionally engage an opposing threaded surface when the protuberances are not in physical contact, such that rotation of the first and second threaded surfaces is not inhibited by the protuberances. In another aspect, the first and second threaded surfaces become frictionally engaged when the root protuberance is disposed between adjacent crest protuberances such that relative rotation of the first and second threaded surfaces is inhibited by the protuberances in both rotational directions.

In another aspect, impingement of the plurality of crest protuberances and the root protuberance may cause a tactile vibration as the plurality of crest protuberances and the root protuberance are moved past each other during relative rotation of the engaged first and second thread surfaces. In another aspect, impingement of the plurality of crest protuberances and the root protuberance may cause an audible sound as the plurality of crest protuberances and the root protuberance are moved past each other during relative rotation of the engaged first and second thread surfaces. In another aspect, a plurality of root protuberances are disposed on the thread root of the first threaded surface.

In another aspect, the plurality of crest protuberances have a non-symmetrical shape whereby resistance to rotation of the threadably engaged first and second surfaces is greater in one rotational direction than in the other rotational direction when the crest protuberances move past the first root protuberance. In another aspect, the first threaded surface is disposed on a pedestal support member and the second threaded surface is disposed on a pedestal base member.

DESCRIPTION OF THE INVENTION

Figure 1:
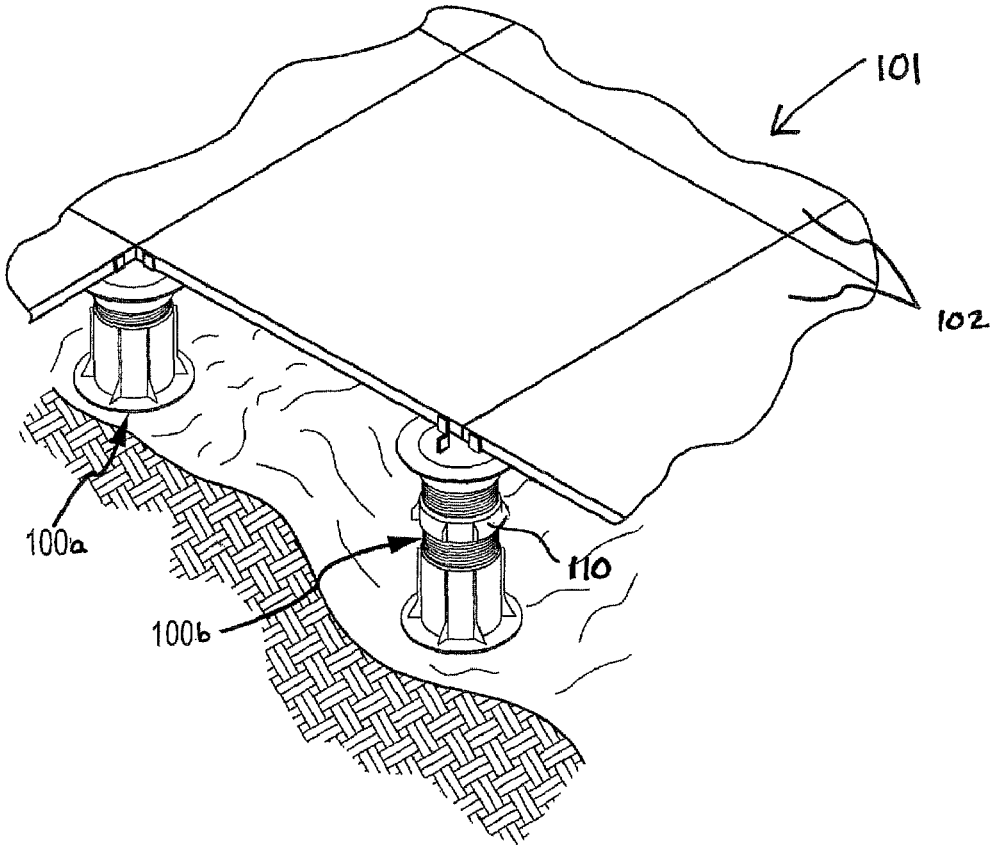
FIG. 1 illustrates a perspective view of a plurality of support pedestals supporting surface tiles in an elevated building surface assembly.

The system described herein for indicating the engagement depth of threadably engaged surfaces is particularly useful for support pedestals, particularly for adjustable-height support pedestals used to support surface tiles in a building surface assembly. By way of example, FIG. 1 illustrates a plurality of support pedestals, such as support pedestals 100*a* and 100*b* that support surface tiles 102 to form an elevated building surface assembly 101. As is illustrated in FIG. 1, the support pedestals 100*a* and 100*b* are placed on a fixed surface and can support a plurality of surface tiles 102 above the fixed surface to form an elevated building surface. The support pedestals 100*a* and 100*b* can be placed on fixed surfaces such as rooftops, on-grade (e.g., natural ground), over concrete slabs including cracked concrete slabs, and can be placed within water features, such as fountains. Although illustrated as supporting surface tiles 102, it will be appreciated that support pedestals can be utilized to support a wide variety of objects.

The surface tiles 102 must often be supported over a fixed surface having an uneven grade or slope. To create a building surface that reduces or eliminates the fluctuations in the fixed surface beneath it, the support pedestals must themselves have different heights. For this reason, height-adjustable support pedestals are often utilized, where the height of each pedestal can be adjusted within a range. For example, as illustrated in FIG. 1, support pedestal 100*b* is taller than support pedestal 100*a* and includes a coupling member 110 for increasing the height of the support pedestal 100*b*. An example of a height-adjustable support pedestal is illustrated, for example, in U.S. Pat. No. 6,363,685 by Kugler, which is incorporated herein by reference in its entirely.

Figure 2:
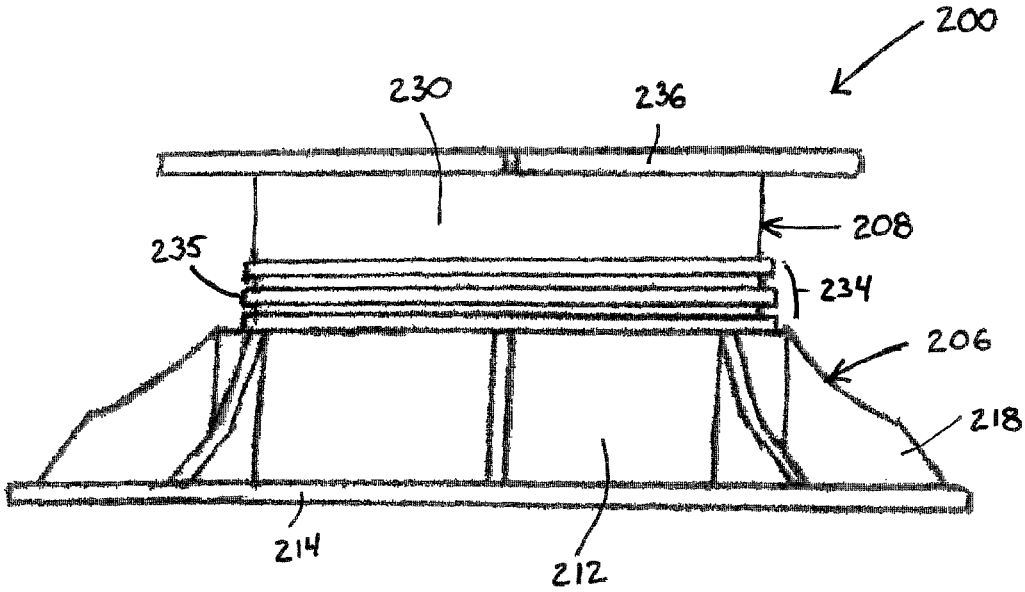
FIG. 2 illustrates a perspective side view of a support pedestal.

FIG. 2 illustrates an exemplary embodiment of a height-adjustable support pedestal 200. The support pedestal 200 includes a base member 206 and a support member 208 that is threadably engaged with the base member 206. The base member 206 includes a base plate 214 that is adapted to be placed upon a fixed surface. A cylindrical base extension 212 extends upwardly and transversely from the base plate 214 and is reinforced by reinforcing flanges 218.

The support member 208 includes a support plate 236 and a cylindrical support extension 230 extending downwardly and transversely from the support plate 236. The cylindrical support extension 230 includes a threaded outer surface 234 having helically disposed support member threads 235 and that is threadably engaged with a threaded inner surface of the cylindrical base extension 212. Thus, the height of the support pedestal 200 can be adjusted by rotating one of the pedestal members relative to the other pedestal member to change the depth of engagement of the two threadably engaged surfaces. However, for the support pedestal 200 to safely support a structure, the threaded surfaces of the cylindrical support extension 230 and the cylindrical base extension 212 must typically be threadably engaged by a minimum engagement depth. However, it is difficult for an operator to know when the minimum desired engagement depth has been reached and often visual verification of the engagement depth can often be difficult during assembly.

Accordingly, a system is provided that may provide sensory indication of the engagement depth of first and second threaded surfaces of support pedestal members. The system may provide sensory indication in the nature of tactile vibration and/or an audible sound, for example. In this manner, the operator will know when a minimum safe engagement depth of the pedestal members has been reached without necessitating visual confirmation of the engagement depth by the operator.

The system may include protuberances that are disposed on the threaded surfaces of the support pedestal, whereby the protuberances may impinge against each other when the threaded surfaces are threadably engaged and rotated to a desired engagement depth. The impingement of the protuberances during relative rotation of the pedestal members can provide sensory indication of the engagement depth of the threaded surfaces. In this regard, the protuberances can be disposed on a predetermined location on each of the threaded surfaces, whereby the location of the protuberances ensures that when the protuberances impinge a desired engagement depth of the threaded surfaces has been reached.

Figure 3:
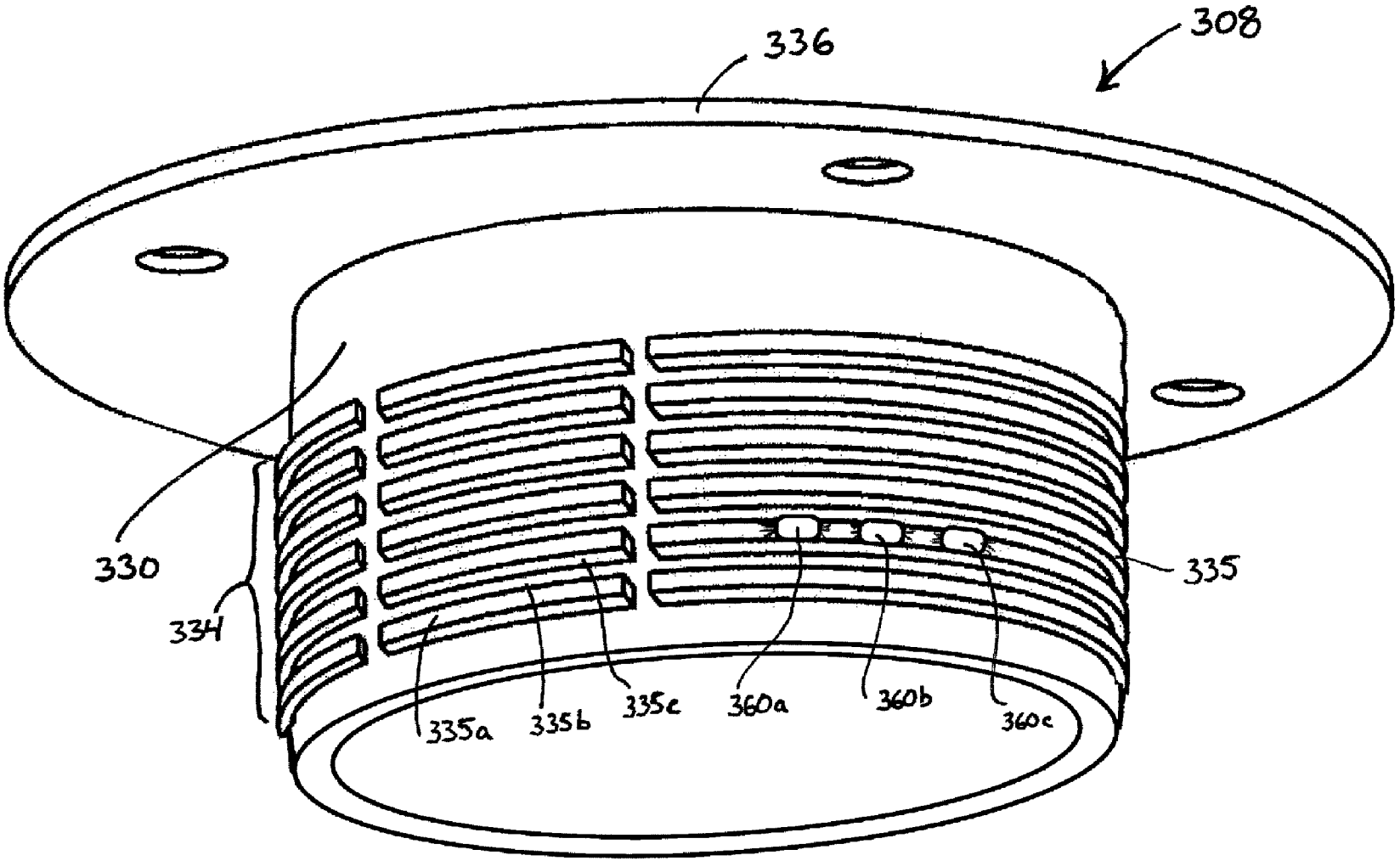
FIG. 3 illustrates a perspective view of a support member that is useful in a support pedestal.
Figure 4:
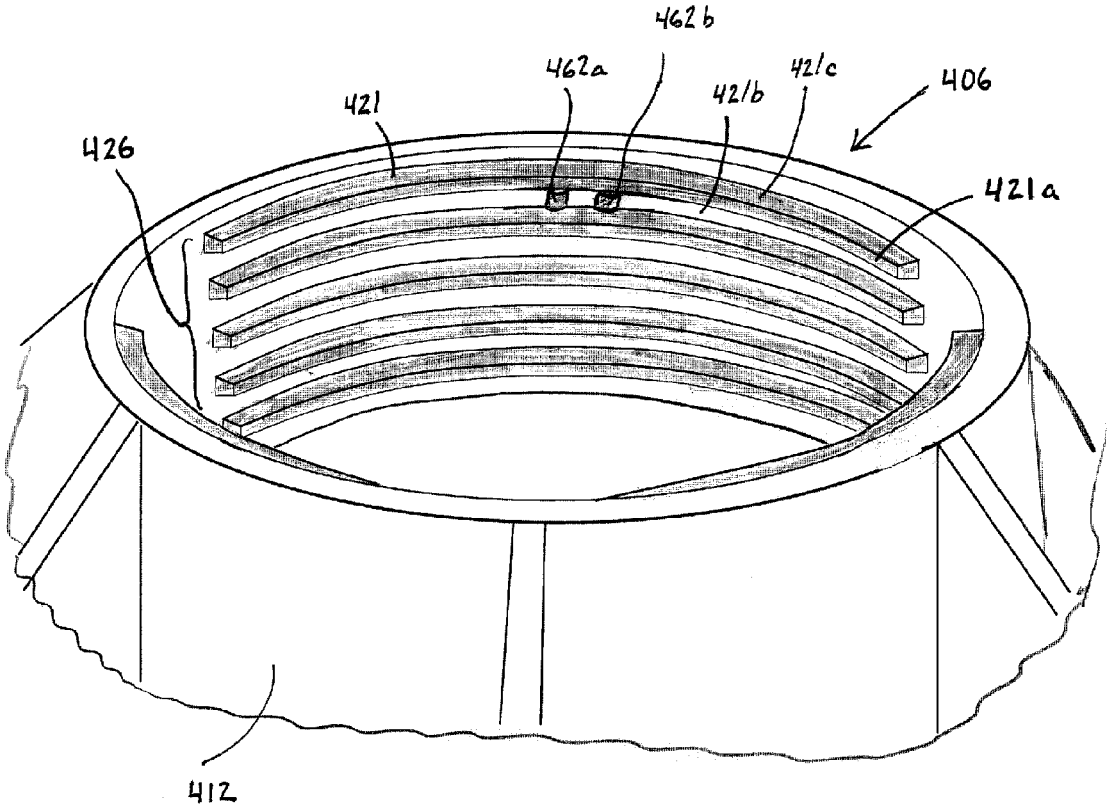
FIG. 4 illustrates a partial perspective view of a base member that is useful in a support pedestal.

By way of example, the pedestal members may include a base member and a support member, as well as one or more coupling members that are adapted to couple support members to base members. FIG. 3 illustrates a perspective view of an exemplary support member 308 that is adapted to be rotatably engaged with a corresponding base member, e.g., a base member as illustrated in FIG. 4. The support member 308 includes a support plate 336 and a cylindrical support extension 330 that extends downwardly and transversely from the support plate 336. The cylindrical support extension 330 includes a threaded outer cylindrical surface 334. The threaded outer surface 334 includes threads 335 having thread crests 335*a* and thread sidewalls 335*c*, and thread roots 335*b* that are disposed between adjacent thread sidewalls 335*c*.

A plurality of thread protuberances 360*a*, 360*b* and 360*c* are disposed on the threaded outer surface 334. As illustrated in FIG. 3, the protuberances 360*a*, 360*b* and 360*c* are disposed on the thread crests 335*a* and extend outwardly therefrom. The support member threads 335 may be in the form of a continuous single thread that is helically disposed on the cylindrical support extension 330, or can be discontinuous, e.g., such that one or more channels are formed along the length of the cylindrical support extension 330, as is illustrated in FIG. 3.

FIG. 4 illustrates a partial perspective view of a base member 406 that is adapted be used with a corresponding support member, e.g., the support member illustrated in FIG. 3. The base member 406 includes a cylindrical base member extension 412. The cylindrical base member extension 412 includes a threaded inner surface 426 comprising helically disposed threads 421 having thread crests 421*a* and thread sidewalls 421*c*. Thread roots 421*b* are disposed between adjacent thread sidewalls 421*c*.

A plurality of spaced-apart thread protuberances 462*a* and 462*b* are disposed on the threaded inner surface 426 in a thread root 421*b* between adjacent thread sidewalls 421*c*. The support member threads 421 may be in the form of a continuous single thread that is helically disposed on the cylindrical base extension 412, or can be discontinuous, e.g., such that one or more channels are formed along the length of the cylindrical base extension 412, as is illustrated in FIG. 4.

Referring to both FIGS. 3 and 4, when the support member 308 is operatively placed onto the base member 406, and rotated in a clockwise direction, the threaded surfaces 334 and 426 will become threadably engaged to threadably engage the base member 406 with the support member 308. As an operator continues to rotate the support member 308 within the base member 406 in a clockwise direction, after about one to two full revolutions for example, the thread crest protuberance 360*a* will impinge upon the thread root protuberance 462*a*. At this point, further clockwise rotation of the support member 308 will be inhibited due to the physical contact between the thread crest protuberance 360*a* and the thread root protuberance 462*a*. That is, a small amount of additional force (e.g., torque) must be applied by the operator to continue clockwise rotation and further threadable engagement of the support member 308 with the base member 406. When additional torque is applied to the support member 308, the thread crest protuberance 360*a* will move past the thread root protuberance 462*a*, and substantially uninhibited rotation of the support member 308 will be restored. This may serve as a tactile indication to the operator that the support member 308 is engaged to a sufficient depth with the base member 406. For example, the tactile indication may be the vibration sensed when the thread crest protuberance 360*a* first impinges upon the thread root protuberance 462*a*, as well as the sensation when the thread crest protuberance 360*a* has fully moved past the thread root protuberance 462*a* and uninhibited rotation of the threadably engaged pedestal members is restored. The impingement of the protuberances 360*a* and 462*a* may also produce an audible sound that may be heard by the operator.

Although each threaded surface 334 and 426 is illustrated as comprising a plurality of thread protuberances, each threaded surface 334 and 426 may be provided with only a single thread protuberance. Further, although the protuberances illustrated in FIGS. 3 and 4 are disposed on a thread crest or a thread root of the threaded surfaces, thread protuberances may be disposed on another portion of the threaded surfaces, such as a thread sidewall 335*c* or 421*c*. For example, the support member threaded surface 334 could comprise a thread protuberance on a thread sidewall 335*c* and the base member threaded surface 426 could include a thread protuberance on a thread sidewall 421*c*, wherein the placement of the thread protuberances is such that the protuberances impinge on each other when the support member 308 is threadably engaged with the base member 406 and rotated to a desired engagement depth.

Further, although described above with respect to the support member 308 being rotated in a clockwise direction to threadably engage the base member 406, the rotation between the support member 308 and the base member 406 is relative and the base member 406 could be rotated in a counterclockwise direction while the support member 308 remains substantially stationary. The tactile indication of engagement depth may also occur when the height of the support pedestal is being increased, such as by rotating the previously-engaged support member 308 counterclockwise relative to the base member 406. In this instance, the thread crest protuberance 360*c* impinges upon the thread root protuberance 462*b* to indicate to the operator that the maximum desired height, i.e., the minimum threaded surface engagement depth, has been reached.

As illustrated in FIGS. 3 and 4, each of the threaded surfaces 334 and 426 includes a plurality of thread protuberances. The thread protuberances may be disposed in spaced-apart relationship along the circumference of the threaded surfaces such that when the first crest protuberance 360*a* is moved past the first thread root protuberance 462*a*, the thread crest protuberance 360*a* will be disposed between the two adjacent thread root protuberances 462*a* and 462*b*. In this manner, relative rotation of the threadably engaged pedestal members in both clockwise and counterclockwise directions will be inhibited. Further, when the first thread crest protuberance 360*a* moves past the first thread root protuberance 462*a* by virtue of the operator applying additional torque to the pedestal members, the first thread crest protuberance 360*a* will be quickly impinge upon the second thread crest protuberance 462*b* to provide the operator with a clear tactile indication that the desired threaded surface engagement depth has been reached. Continuing to apply torque to the support member 308 will continue to produce a tactile vibration easily sensed by the operator until the thread crest protuberance 360*c* moves past the thread root protuberance 462*b*. Although illustrated in FIGS. 3 and 4 as comprising three protuberances on the support member threaded surface 334 and two protuberances on the base member threaded surface 426, it will be appreciated that any combination of a single protuberance or a plurality of protuberances may be utilized on the threaded surfaces.

Figure 5:
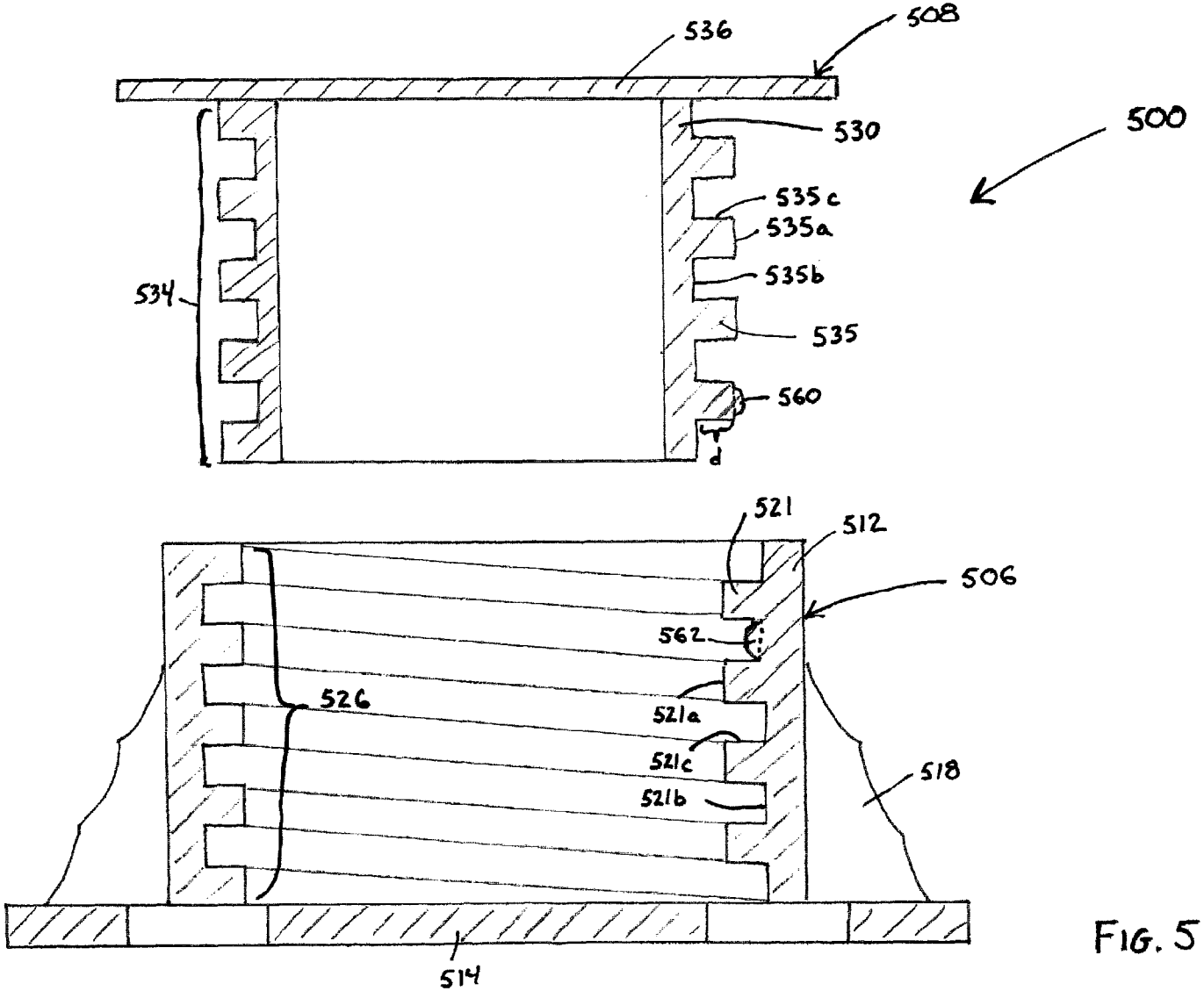
FIG. 5 illustrates an exploded cross-sectional view of a support pedestal.

FIG. 5 illustrates a cross-sectional side view of an exemplary support pedestal 500 that includes a system for indicating the engagement depth of the threadably engaged surfaces of the pedestal members. The support pedestal 500 includes a base member 506 and a support member 508 that is adapted to be threadably engaged with the base member 506. In this regard, the base member 506 includes a cylindrical base extension 512 and a base member threaded surface 526.

The support member 508 includes a support plate 536 and a cylindrical support extension 530 extending downwardly and transversely from the support plate 536. The cylindrical support extension 530 includes a support member threaded surface 534 comprising helically disposed support member threads 535 that are adapted to be rotatably engaged with the base member threads 521. Thus, the support member threads 535 and the base member threads 521 may have substantially the same thread size and thread pitch to enable the support member 508 to be rotatably engaged with the base member 506.

The base member threaded surface 526 comprises helically disposed base member threads 521 having thread crests 521*a* and thread sidewalls 521*c*. Thread roots 521*b* are disposed between adjacent sidewalls 521*c* of the threaded surface 526. Likewise, the support member threaded surface 534 includes helically disposed support member threads 535 comprising thread crests 535*a* and thread sidewalls 535*c*, and includes thread roots 535*b* disposed between adjacent thread sidewalls 535*c*. Thus, when the two pedestal member threaded surfaces 534 and 526 are threadably engaged, the thread crests 535*a* of the support member 508 are disposed within the thread roots 521*b* of the base member 506, and the thread crests 521*a* are disposed within the thread roots 535*b*.

As is discussed with respect to FIGS. 3 and 4, to tactilely indicate the depth of engagement of the two threadably engaged surfaces, each of the threaded surfaces is provided with at least one thread protuberance. In this manner, the protuberances may impinge against each other when the threaded surfaces are threadably engaged to a desired engagement depth. The protuberances may be shaped and sized such that when the protuberances are not in physical contact with each other, each pedestal member is freely rotatable with respect to the other pedestal member. When the support member 508 and the base member 506 are threadably engaged and are rotated relative to each other, the protuberances may come into physical contact and may provide sensory indication of the depth of engagement of the two threaded surfaces.

As illustrated in FIG. 5, a crest protuberance 560 is disposed on a crest 535*a* of the threaded surface 534. A root protuberance 562 is disposed within a root 521*b* of the base member threaded surface 526. The protuberances 560 and 562 may comprise, for example, small nubs that project from their respective threaded surfaces. The size of the threads and protuberances illustrated in FIG. 5 are somewhat exaggerated for purposes of clarity. The protuberances may be sized so that when a root protuberance comes into contact with a crest protuberance, the protuberances may be moved past each other by applying additional rotational force, i.e., torque, to the pedestal members, but without requiring excessive torque to be applied.

In this regard, the protuberances 560 and 562 may be large enough to cause a tactile sensation (e.g., a vibration) and/or an audible sound as they are moved past each other, However, the protuberances 560 and 562 should not be so large as to substantially inhibit relative rotation and threadable engagement of the support members. Therefore, the root protuberance 562 preferably does not extend beyond the crest of the threads. For example, the root protuberance 562 may extend to 50% or less of the thread depth, 25% or less of the thread depth. In this regard, the threads may have a thread depth (d) of at least about 1/16 inch and not greater than about 1/4 inch, for example.

Likewise, the crest protuberance 560 does not extend significantly beyond the crest of the thread. More specifically, the crest protuberance 560 should not be so large as to inhibit operative placement of the support member 508 into the base member 506, or to inhibit relative rotation of the pedestal members when the thread protuberances are not in contact. In this manner, the pedestal members can be freely rotated relative to each other until the protuberances come into physical contact, indicating that a predetermined engagement depth has been reached.

Figure 6:
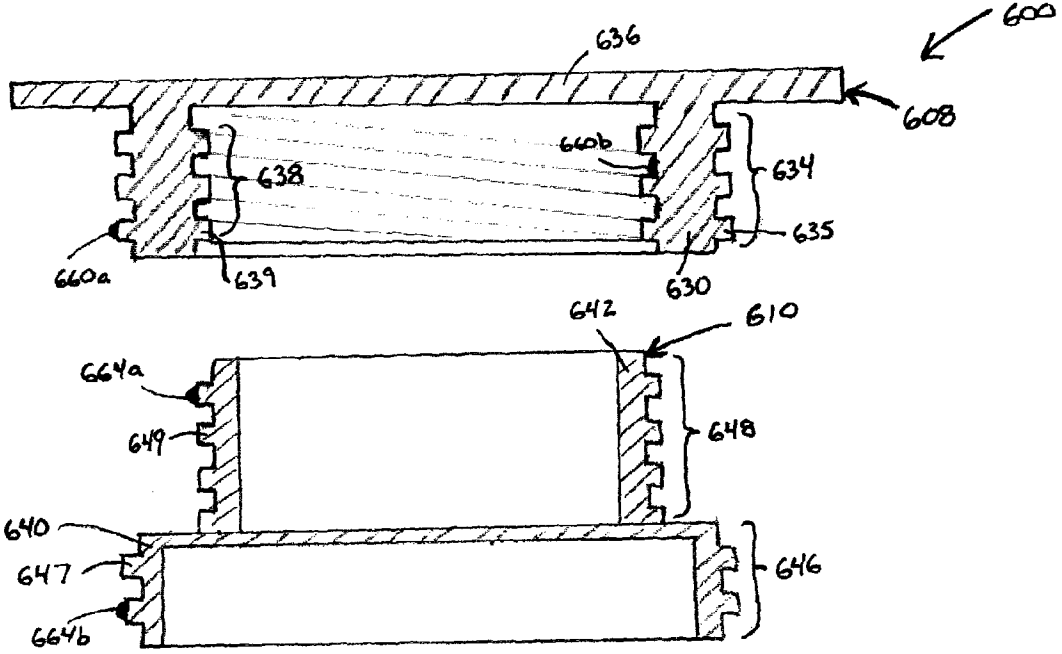
FIG. 6 illustrates an exploded cross-sectional view of a support pedestal including a coupling member.
Figure 6:
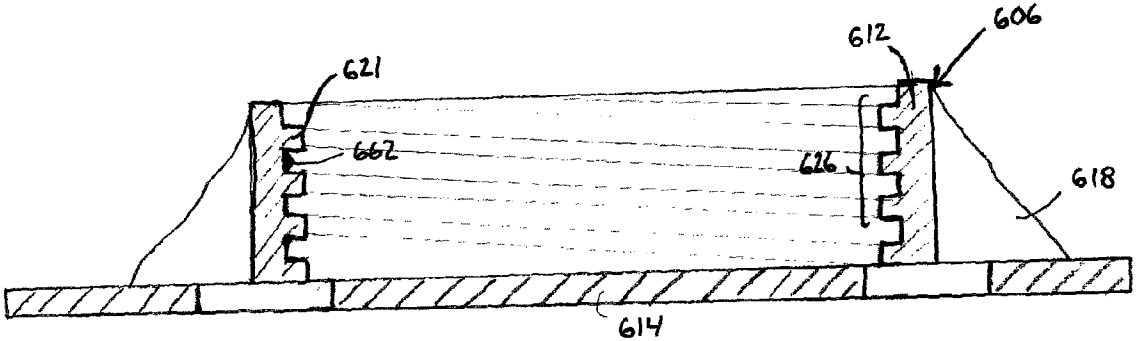

As is noted above, the support pedestals may include one or more coupling members to further increase the height of the support pedestal. FIG. 6 illustrates a cross-sectional view of another exemplary support pedestal. The pedestal 600 has an adjustable height to enable the construction of a level surface above a fixed surface that is not level, and/or to create desirable architectural features. The support pedestal 600 comprises three support pedestal members—a base member 606, a support member 608, and a coupling member 610 that is adapted to be disposed between the base member 606 and the support member 608 to operatively couple the support member 608 to the base member 606 to increase the height of the support pedestal 600.

The base member 606 includes a base plate 614 that is adapted to be placed upon a fixed surface. The base member 606 also includes a cylindrical base extension 612 that extends upwardly and transversely away from the base plate 614. Reinforcing flanges 618 may be provided to enhance the strength and stability of the base member 606. The base member 606 includes a threaded surface 626 on the interior of the cylindrical base extension 612.

The support member 608 is adapted to be disposed of the top of the support pedestal 600. The support member 608 includes a cylindrical support extension 630 that extends transversely in downwardly from a support plate 636. The support extension 630 includes an outer threaded surface 634 disposed on the cylindrical support extension 630. The outer threaded surface 634 includes first support member threads 635 that are helically disposed on the cylindrical support extension 630. The cylindrical support extension 630 also includes an inner threaded surface 638 that includes helically disposed support member threads 639.

The support pedestal 600 may also include a coupling member 610 that is adapted to be disposed between the base member 606 and support member 608. The coupling member 610 can advantageously enable the height of the support pedestal 600 to be adjusted over a broad height range with substantially no gaps in the achievable height within the height range. The coupling member 610 may include a first cylindrical engagement portion 640 and a second cylindrical engagement portion 642. The first cylindrical engagement portion 640 may include an outer threaded surface 646 having helically disposed threads 647 and the second cylindrical engagement portion 642 may include an outer threaded surface 648 having helically disposed threads 649. In this regard, the threaded surface 646 may be adapted to be rotatably engageable with the inner threaded surface 626 of the base member 606, and the threaded surface 648 may be adapted to be rotatably engageable with the inner threaded surface 638 of the support member 608. In this regard, the first cylindrical engagement portion 640 may have an outer diameter that is greater than the outer diameter of the second cylindrical engagement portion 642. Thus, the base member 606 and support member 608 can be rigidly coupled via the coupling member 610 to form the support pedestal 600.

To tactilely indicate the engagement depth of the coupling member 610 with the support member 608 and/or the base member 606, the coupling member 610 may also be provided with one or more thread protuberances on the threaded surfaces. For example, the height coupling member 610 may include a thread protuberance **664*b* that disposed on the threaded surface 646. Thus, when an operator begins to rotate the coupling member 610 relative to the base member 606, the threaded surfaces 626 and 646 will at first easily engage and the pedestal members will freely rotate. As the operator continues to rotate the height adjusting member 610 relative to the base member 606, the protuberance 664*b* and the protuberance 662 will impinge. When these two protuberances come into contact, the operator will feel resistance to further rotation of the pedestal members, thereby giving the operator tactile feedback regarding the depth of the engagement between the base member 606 and the coupling member 610**.

At this point, the operator can apply a moderate amount of additional torque such that the protuberances 662 and **664*b* can move past each other. When the protuberances move past each other, the protuberances can also advantageously produce a clicking noise to audibly indicate to the operator that the threaded surfaces 626 and 646 have passed the point where they are sufficiently engaged, particularly if either or both of the threaded surfaces 626 and 646** includes a plurality of protuberances disposed in spaced-apart relation. The operator can then continue to rotate the pedestal members relative to each other to obtain the desired pedestal height.

Similarly, if the operator begins to rotate the coupling member 610 relative to the base member 606 in the opposite (e.g., counter-clockwise) direction, the operator will again reach the point where the protuberances 662 and **664*b* impinge to indicate to the operator that the support pedestal members can no longer be rotated without jeopardizing the structural safety of the pedestal 600**.

In a similar manner, the threaded surface 648 of the second cylindrical engagement portion 642 may also include a protuberance **664*a*. The protuberance 664*a* is adapted to impinge upon a protuberance 660*b* that is disposed on the threaded surface 638 of the support member 608. The threaded surface 634 of the support member 608 also includes a protuberance 660*a* that is adapted to impinge upon the protuberance 662 of the base member 606 when the support member 608 is threadably engaged directly with the base member 606**.

Figure 7:
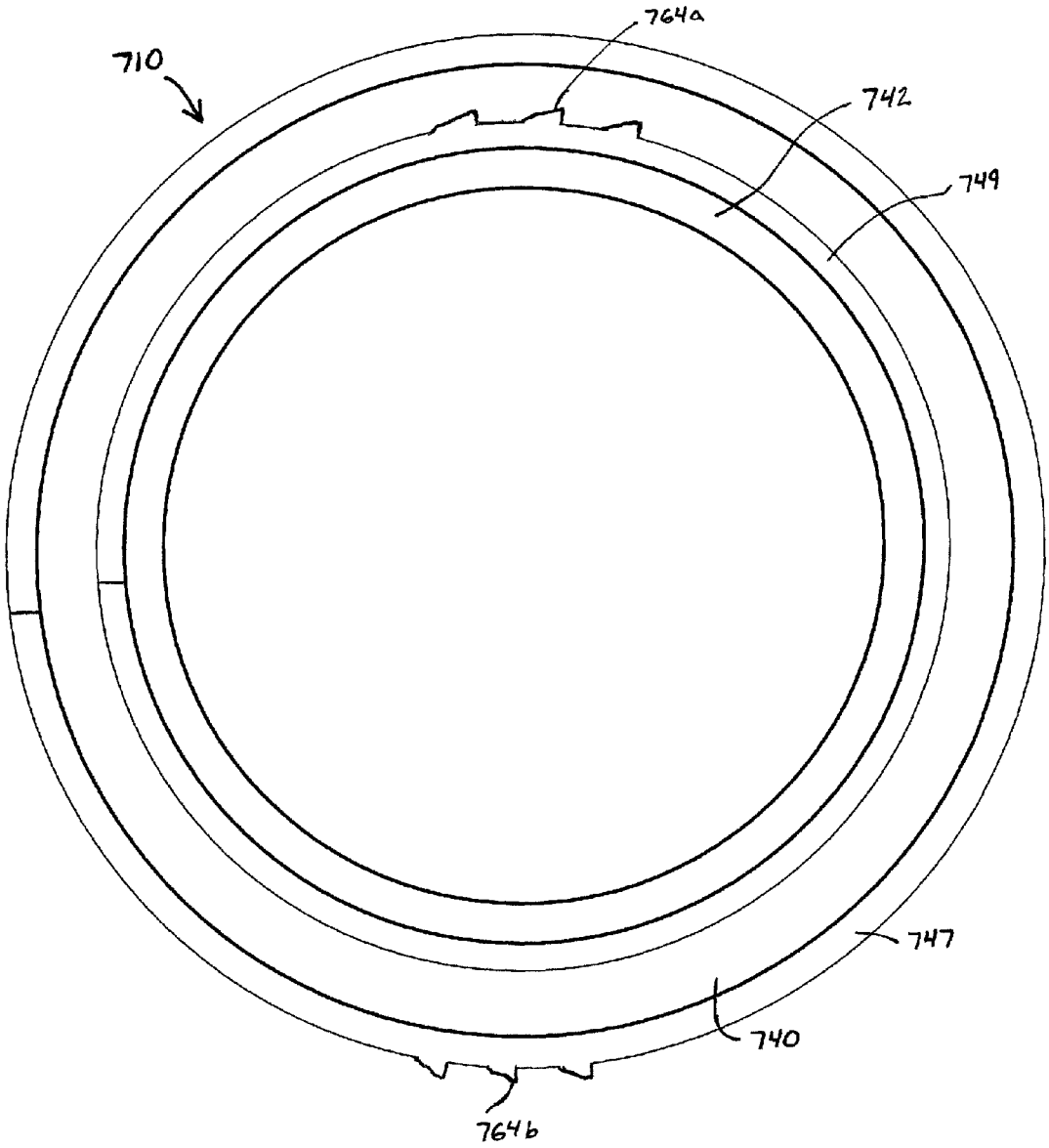
FIG. 7 illustrates a top view of a coupling member for a support pedestal.

Referring to FIG. 7, a top view of the coupling member 710 is illustrated. The coupling member 710 is substantially identical to the coupling member 610 illustrated in FIG. 6. As is illustrated in FIG. 7, the protuberances **764*a* and 764*b* are disposed on threads 749 and 747, respectively. The protuberances illustrated in FIG. 7** are not symmetrical and have an angled shape, such that relative rotation in one direction is inhibited to a greater degree than relative rotation in the opposite direction.

Although system for indicating an engagement depth is illustrated with respect to several exemplary support pedestals, it will be appreciated that such a system can be utilized in conjunction with virtually any type of support pedestal that utilizes threads to rotatably engage one pedestal member with another pedestal member.

The support pedestal members can be fabricated from a wide variety of materials. Preferably, the material will be able to withstand prolonged exposure to moisture and/or ultraviolet radiation so that the support pedestal can be utilized in outdoor applications. In one particular aspect, the support pedestal members may be fabricated from a high density, durable and impact resistant polymer, such as polypropylene. The protuberances may, for example, be molded directly on the threaded surfaces of a molded polymer support pedestal member. However, the support pedestal members or portions of the pedestal members can be fabricated from other materials, including composite materials. Further, it is not necessary that each member of the support pedestal be fabricated from the same material.

While various embodiments of the present invention have been described in detail, it is apparent that modifications and adaptations of those embodiments will occur to those skilled in the art. For example, although the illustrated embodiments comprise a base member having internal threads and a support member having internal and/or external threads, it will be apparent that the threads can be inter-related in different ways. For example. the base member could comprise an outer threaded surface, and the support member could comprise only an inner threaded surface. Further, although the pedestal members are described as separate members, it will be readily appreciated that the members can be distinct or can be integrally attached to one another. It is to be expressly understood that these and other such modifications and adaptations are within the spirit and scope of the present invention.

What is claimed is:

1. A system for indicating a depth of engagement of two threadably engaged surfaces of a support pedestal, comprising:

at least a first thread protuberance disposed on a first threaded surface of the support pedestal; and at least a second thread protuberance disposed on a second threaded surface of the support pedestal, whereby the first thread protuberance impinges against the second thread protuberance when the first and second threaded surfaces are threadably engaged and rotated to provide sensory indication of a depth of engagement of the first and second threaded surfaces.

2. A system as recited in claim 1, wherein the first and second thread protuberances do not frictionally engage an opposing threaded surface when the first and second thread protuberances are not in physical contact such that relative rotation of the first and second threaded surfaces is not inhibited.

3. A system as recited in claim 1, wherein the first thread protuberance and the second thread protuberance become frictionally engaged when they are in physical contact such that relative rotation of the first and second threaded surfaces in at least one direction is inhibited.

4. A system as recited in claim 1, wherein the impingement of the first thread protuberance and the second thread protuberance causes a tactile vibration as the first thread protuberance and the second thread protuberance are moved past each other during relative rotation of the engaged first and second threaded surfaces.

5. A system as recited in claim 1, wherein the impingement of the first thread protuberance and the second thread protuberance causes an audible sound as the first thread protuberance and the second thread protuberance are moved past each other during relative rotation of the first and second threaded surfaces.

6. A system as recited in claim 1, wherein the first thread protuberance has a non-symmetrical shape whereby resistance to rotation of the engaged first and second threaded surfaces is greater in one rotational direction than in the other rotational direction when the first thread protuberance moves past the second thread protuberance.

7. A system as recited in claim 1, wherein the first thread protuberance is disposed within a thread root of the first threaded surface.

8. A system as recited in claim 7, wherein the second thread protuberance is disposed on a thread crest of the second threaded surface.

9. A system as recited in claim 1, wherein the first thread protuberance is disposed on a thread sidewall of the first threaded surface, and the second thread protuberance is disposed on a thread sidewall of the second threaded surface.

10. A system as recited in claim 1, wherein a plurality of spaced-apart thread protuberances are disposed on the first threaded surface.

11. A system as recited in claim 10, wherein a plurality of spaced-apart thread protuberances are disposed on the second threaded surface.

12. A system as recited in claim 1, wherein the first threaded surface is disposed on a base member and the second threaded surface is disposed on a support member.

13. A system as recited in claim 12, further comprising a coupling member having at least a third threaded surface and comprising at least a third thread protuberance disposed on the third threaded surface.

14. A system for indicating a depth of engagement of two threadably engaged surfaces of a support pedestal, comprising:

a plurality of spaced-apart root protuberances disposed on a thread root of a first threaded surface of the support pedestal; and at least a first crest protuberance projecting from a crest of a second threaded surface of the support pedestal, whereby the first crest protuberance impinges against the plurality of root protuberances when the first and second threaded surfaces are threadably engaged and rotated to provide sensory indication of a depth of engagement of the threaded surfaces.

15. A system as recited in claim 14, wherein the root protuberances and crest protuberance do not frictionally engage an opposing threaded surface when the protuberances are not in physical contact, such that relative rotation of the first and second threaded surfaces is not inhibited.

16. A system as recited in claim 14, wherein the first and second threaded surfaces become frictionally engaged when the crest protuberance is disposed between adjacent root protuberances such that relative rotation of the first and second threaded surfaces is inhibited in both rotational directions.

17. A system as recited in claim 14, wherein impingement of the plurality of root protuberances and the crest protuberance causes a tactile vibration as the plurality of root protuberances and the crest protuberance are moved past each other during relative rotation of the engaged first and second threaded surfaces.

18. A system as recited in claim 14, wherein the impingement of the plurality of root protuberances and the crest protuberance causes an audible sound as the plurality of root protuberances and the crest protuberance are moved past each other.

19. A system as recited in claim 14, wherein a plurality of thread crest protuberances are disposed on the thread crest of the second threaded surface.

20. A system as recited in claim 14, wherein the first crest protuberance has a non-symmetrical shape whereby resistance to rotation of the engaged first and second threaded surfaces is greater in one rotational direction than in the other rotational direction when the first crest protuberance moves past the plurality of root protuberances.

21. A system as recited in claim 14, wherein the first threaded surface is disposed on a pedestal support member and the second threaded surface is disposed on a pedestal base member.

22. A system for indicating a depth of engagement of two threadably engaged surfaces of a support pedestal, comprising:

at least a first root protuberance disposed on a thread root of a first threaded surface of the support pedestal; and a plurality of spaced-apart crest protuberances disposed on a thread crest of a second threaded surface of the support pedestal, whereby the first root protuberance impinges against the plurality of crest protuberances when the first and second threaded surfaces are threadably engaged and rotated to provide sensory indication of a depth of engagement of the threaded surfaces.

23. A system as recited in claim 22, wherein the root protuberances and the crest protuberance do not frictionally engage an opposing threaded surface when the protuberances are not in physical contact, such that rotation of the first and second threaded surfaces is not inhibited.

24. A system as recited in claim 22, wherein the first and second threaded surfaces become frictionally engaged when the root protuberance is disposed between adjacent crest protuberances such that relative rotation of the first and second threaded surfaces is inhibited in both rotational directions.

25. A system as recited in claim 22, wherein impingement of the plurality of crest protuberances and the root protuberance causes a tactile vibration as the plurality of crest protuberances and the root protuberance are moved past each other during relative rotation of the engaged first and second threaded surfaces.

26. A system as recited in claim 22, wherein impingement of the plurality of crest protuberances and the root protuberance causes an audible sound as the plurality of crest protuberances and the root protuberance are moved past each other during relative rotation of the engaged first and second threaded surfaces.

27. A system as recited in claim 22, wherein a plurality of root protuberances are disposed on the thread root of the first threaded surface.

28. A system as recited in claim 22, wherein the plurality of crest protuberances have a non-symmetrical shape whereby resistance to rotation of the engaged first and second threaded surfaces is greater in one rotational direction than in the other rotational direction when the crest protuberances move past the first root protuberance.

29. A system as recited in claim 22, wherein the first threaded surface is disposed on a pedestal support member and the second threaded surface is disposed on a pedestal base member.

* * * * *